US007418865B2

(12) United States Patent
Griffiths et al.

(10) Patent No.: US 7,418,865 B2
(45) Date of Patent: Sep. 2, 2008

(54) METHOD AND APPARATUS FOR ULTRASOUND VELOCITY MEASUREMENTS IN DRILLING FLUIDS

(75) Inventors: Roger Griffiths, Abu Dhabi (AE); Miguel Pabon, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 33 days.

(21) Appl. No.: 10/540,403

(22) PCT Filed: Nov. 21, 2003

(86) PCT No.: PCT/EP03/13146

§ 371 (c)(1),
(2), (4) Date: Jun. 23, 2005

(87) PCT Pub. No.: WO2004/059126

PCT Pub. Date: Jul. 15, 2004

(65) Prior Publication Data

US 2006/0101916 A1 May 18, 2006

(30) Foreign Application Priority Data

Dec. 31, 2002 (EP) ..... 02293279

(51) Int. Cl.
*G01N 29/024* (2006.01)
*G01V 1/40* (2006.01)
*G01V 1/00* (2006.01)

(52) U.S. Cl. ..... 73/597; 73/152.01; 73/152.02; 73/152.18; 181/102; 367/25

(58) Field of Classification Search ..... 73/597, 73/152.01, 152.03, 152.04, 152.06, 152.18, 73/152.28, 152.46, 152.53, 152.19, 152.02; 181/102; 367/25
See application file for complete search history.

(56) References Cited

U.S. PATENT DOCUMENTS 2,701,123 A * 2/1955 Moore ..... 175/319

(Continued)

FOREIGN PATENT DOCUMENTS

EP 0657622 6/1995

(Continued)

*Primary Examiner*—Hezron E. Williams
*Assistant Examiner*—Jacques M. Saint-Surin
(74) *Attorney, Agent, or Firm*—Jaime Castano

(57) ABSTRACT

The disclosure relates to methods and apparatus for determining the velocity of an ultrasound pulse in drilling fluids in downhole environments. A method for determining a velocity of ultrasound propagation in a drilling fluid in a downhole environment includes emitting an ultrasound pulse into the drilling fluid in a borehole using a first ultrasound transducer (37); detecting the ultrasound pulse after the ultrasound pulse has traveled a distance (d); determining a travel time (t) required for the ultrasound pulse to travel the distance (d); and determining the velocity of ultrasound propagation from the known distance (d) and the travel time (t). An apparatus for determining a velocity of ultrasound propagation in a drilling fluid in a downhole environment includes a first ultrasound transducer (37) disposed on a tool; and a circuitry (82) for controlling a timing of an ultrasound pulse transmitted by the first ultrasound transducer (37) and for measuring a time lapse between ultrasound transmission and detection after the ultrasound pulse has traveled a distance (d).

11 Claims, 10 Drawing Sheets

U.S. PATENT DOCUMENTS

| | | | | | |
|---|---|---|---|---|---|
| 2,978,634 | A | * | 4/1961 | Arps | 73/702 |
| 3,211,243 | A | * | 10/1965 | Bodine, Jr. | 175/57 |
| 4,008,608 | A | * | 2/1977 | Reynolds | 73/152.12 |
| 4,532,812 | A | * | 8/1985 | Birchak | 73/861.27 |
| 4,665,511 | A | | 5/1987 | Rodney et al. | |
| 4,692,908 | A | | 9/1987 | Ekstrom et al. | |
| 5,069,297 | A | * | 12/1991 | Krueger et al. | 175/65 |
| 5,179,541 | A | * | 1/1993 | Weido | 367/69 |
| 5,430,259 | A | * | 7/1995 | Warner | 181/105 |
| 6,415,648 | B1 | * | 7/2002 | Peeters | 73/38 |
| 6,488,085 | B1 | * | 12/2002 | Milne et al. | 166/254.2 |
| 6,648,083 | B2 | * | 11/2003 | Evans et al. | 175/41 |
| 6,938,458 | B2 | * | 9/2005 | Han et al. | 73/19.09 |
| 6,959,773 | B2 | * | 11/2005 | Mese et al. | 175/65 |
| 2004/0095847 | A1 | * | 5/2004 | Hassan et al. | 367/25 |

FOREIGN PATENT DOCUMENTS

| | | | |
|---|---|---|---|
| WO | WO0016128 | A | 3/2000 |
| WO | WO02068796 | A | 9/2002 |

* cited by examiner

METHOD AND APPARATUS FOR ULTRASOUND VELOCITY MEASUREMENTS IN DRILLING FLUIDS

BACKGROUND OF INVENTION

Accurate borehole dimension data are important for well logging and well completion. Measurements performed by many logging tools, whether wireline, logging-while-drilling (LWD), or measurement-while-drilling (MWD) tools, are sensitive to borehole sizes or tool standoffs. Therefore, accurate borehole dimension information may be required to correct measurements obtained with these tools. Furthermore, information regarding a borehole dimension is used to determine well completion requirements, such as the amount of cement required to fill the annulus of the well. In addition, borehole dimension data may be used to monitor possible borehole washout or impending borehole instability such that a driller may take remedial actions to prevent damage or loss of the borehole or drilling equipment.

Borehole dimensions, such as diameter, may be determined with various methods known in the art, including ultrasound pulse echo techniques disclosed by U.S. Pat. Nos. 4,661,933 and 4,665,511. Such ultrasound measurements rely on knowledge of the velocity of the ultrasound pulse in the particular medium, e.g., drilling fluids.

However, the velocity of an ultrasound pulse, typically, is not easily measured in a wellbore. Instead, the velocity of an ultrasound pulse in the well is typically extrapolated from an ultrasound velocity measurement made at the surface based on certain assumptions concerning the mud properties under downhole conditions. Such assumptions may not be accurate. Furthermore, mud properties in a drilling operation may change due to changes in the mud weight used by the driller, pump pressure, and mud flow rate. In addition, the drilling mud may become contaminated with formation fluids and/or earth cuttings. All these factors may render inaccurate the velocity of an ultrasound pulse estimated from a surface determination.

Therefore, there is a need for improved methods and apparatus for the measurement of ultrasound velocity in downhole environments.

SUMMARY OF INVENTION

In one aspect, the invention relates to methods for determining a velocity of ultrasound propagation in a drilling fluid in a downhole environment. A method according to one embodiment of the invention includes emitting an ultrasound pulse into the drilling fluid in a borehole using a first ultrasound transducer (37); detecting the ultrasound pulse after the ultrasound pulse has traveled a distance (d); determining a travel time (t) required for the ultrasound pulse to travel the distance (d); and determining the velocity of ultrasound propagation from the distance (d) and the travel time (t).

In another aspect, the invention relates to apparatus for determining a velocity of ultrasound propagation in a drilling fluid in a downhole environment. An apparatus according to the invention includes a first ultrasound transducer (37) disposed on a tool; and a circuitry (82) for controlling a timing of an ultrasound pulse transmitted by the first ultrasound transducer (37) and for measuring a time lapse between ultrasound transmission and detection after the ultrasound pulse has traveled a distance (d). The apparatus may further comprise a second ultrasound transducer (39). The first and second ultrasound transducer (37 and 39) may be arranged across a fluid channel. Alternatively, they may be arranged on a surface of the tool. Furthermore, the first and the second ultrasound transducer (37 and 39) may be adjacent each other with a front face (37*f*) of the first ultrasound transducer (37) and a front face (39*f*) of the second ultrasound transducer (39) offset at a predetermined offset distance ($\Delta D_f$).

Other aspects and advantages of the invention will be apparent from the following description and the appended claims.

DETAILED DESCRIPTION

The invention relates to methods and apparatus for determining ultrasound velocity in drilling muds under downhole conditions. Methods for determining the velocity of an ultrasound pulse, in accordance with one embodiment of the invention, measure the time ("travel time") it takes the ultrasound pulse to travel a known distance (d) in the mud under downhole conditions. Once the velocity of an ultrasound pulse is known, it may be used to calculate downhole parameters, e.g., borehole diameters. Alternatively, the downhole parameters may be determined, according to another embodiment of the invention, by using two ultrasound transducers disposed at different distances from the target surface.

Figure 1:
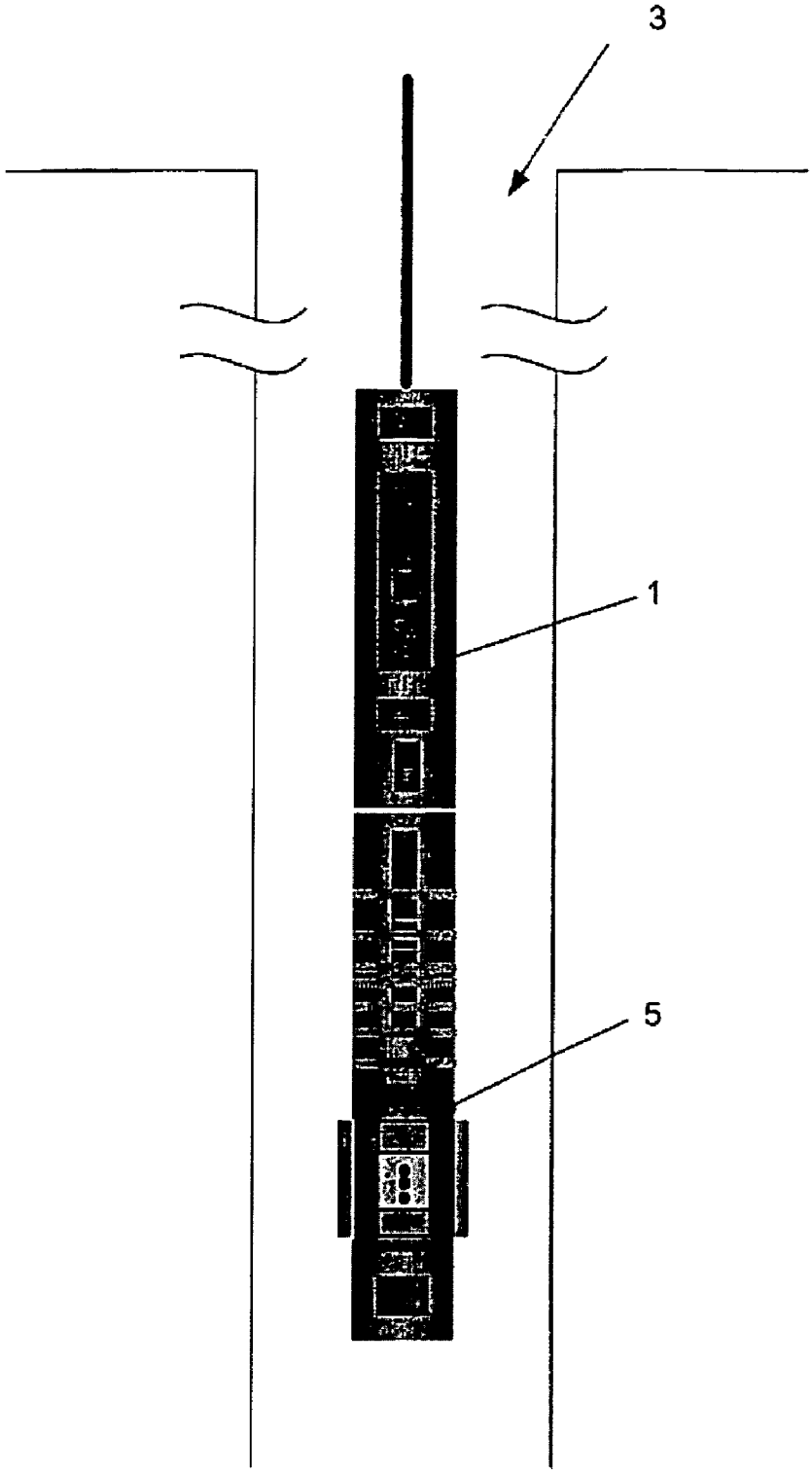
FIG. 1 shows a logging tool disposed in a borehole.

Methods and apparatus of the present invention are useful in well logging. Embodiments of the invention may be used in a wireline tool, an MWD tool, or an LWD tool. FIG. 1 shows a logging tool (1) inserted in a borehole (3). The logging tool (1) may include various devices, such as an ultrasound transducer (5), for measuring the borehole or formation properties. For example, the ultrasound transducer (5) may be used to determine the borehole radius by measuring the distance between the ultrasound transducer (5) and the borehole's interior surface. The distance may be determined from the travel time of the ultrasound pulse and the velocity of the ultrasound pulse in the mud.

Figure 2:
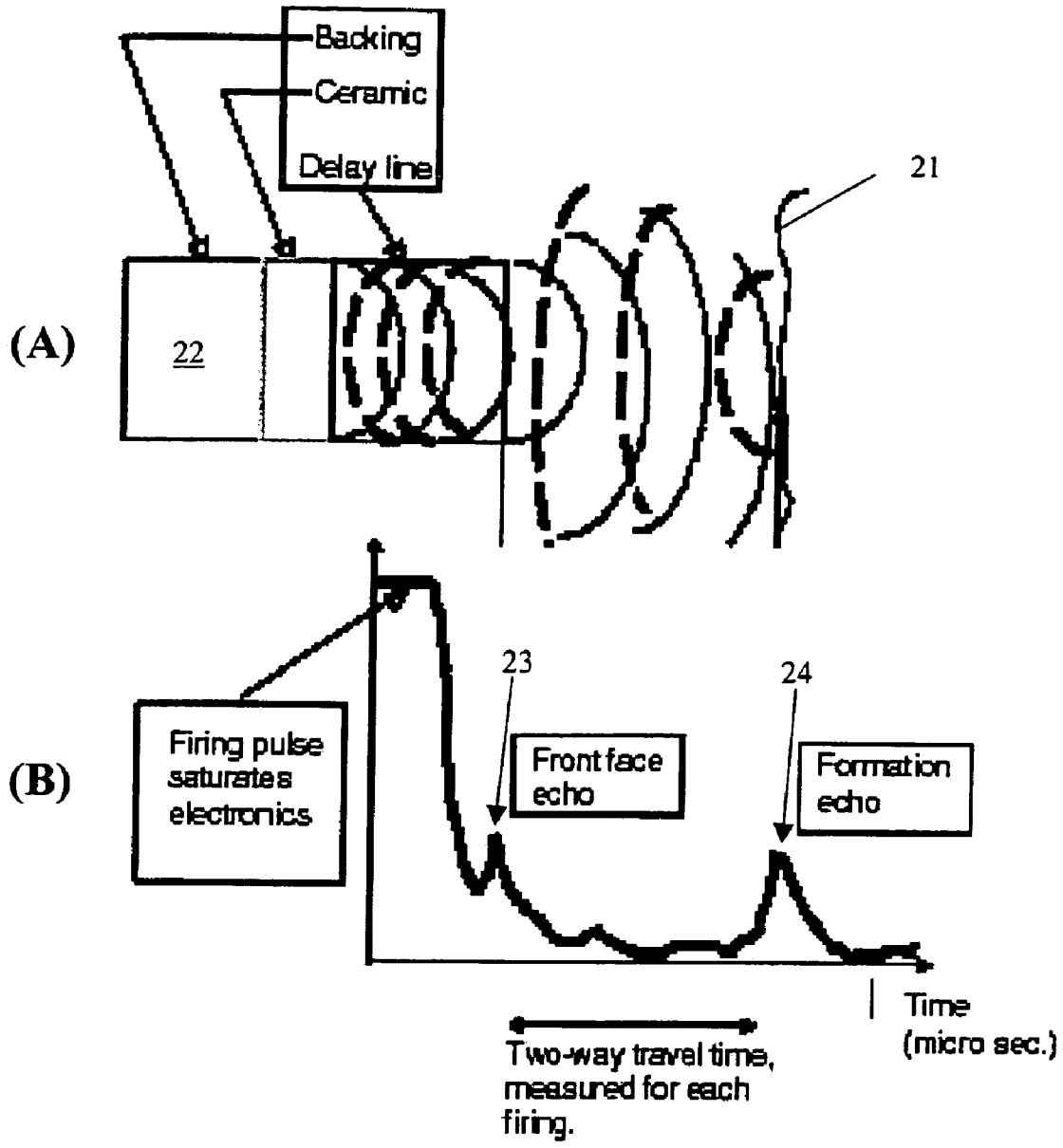
FIGS. 2A and 2B is illustrate a prior art method for determining a velocity of an ultrasound pulse.

The travel time of an ultrasound pulse is typically measured by firing the ultrasound pulse at a reflective surface and recording the time it takes the ultrasound pulse to travel to the reflective surface and back to the transducer. FIG. 2A illustrates a schematic of ultrasound waves (shown in continuous lines) traveling to a reflective surface (21) and back (shown in dotted lines), using a conventional setup. The ultrasound wave may be generated by an ultrasound transducer (22), which typically comprises a piezoelectric ceramic or a magnetostrictive material that can convert electric energy into vibration, and vice versa. The ultrasound transducer (22) may function both as a transmitter and a receiver. The transducer preferably is configured such that it emits a pulse in a collimated fashion in a direction substantially toward the reflective surface with little or no dispersion. The transducers discussed herein may, for example, be transducers such as those described in U.S. Pat. No. 6,466,513 (Acoustic sensor assembly, Pabon et al.)

FIG. 2B shows a typical recording of ultrasound vibration magnitudes as a function of time as detected by the transducer (22). Two peaks are discernable in this recording. The first peak (23) arises from the front face echo, which is the vibration of the ceramic element when the ultrasound pulse leaves the front face of the transducer (22). The second peak (24) results from the echo returning to the transducer (22). Thus, the time period between the detection of the first and the second peaks represents the travel time for the ultrasound pulse from the transducer (22) to the reflective surface (21) and back. This time is equal to twice the time it takes the ultrasound pulse to travel from the transducer (22) to the reflective surface (21). The time lapse may be measured using any analog or digital timing device adapted to interface with, for example, the circuitry that controls the ultrasound transducers.

Once the travel time is determined, it is possible to determine the distance between the transducer (22) and the reflective surface (21) if the velocity of the ultrasound pulse in the medium is known. As noted above, the velocity of an ultrasound pulse in a drilling fluid in the borehole is typically measured at the earth surface. The velocity thus determined is then corrected for effects of temperature, pressure, and other factors expected in downhole environments. However, this approach does not always produce an accurate velocity of the ultrasound pulse in downhole environments due to errors in predicting the downhole conditions (e.g., temperature and pressure) or due to other unexpected factors (e.g., the drilling fluid may mix with formation fluids and/or earth cuttings). In order to obtain reliable velocity of an ultrasound pulse, it is desirable to measure the velocity of the ultrasound pulses in situ.

Figure 3:
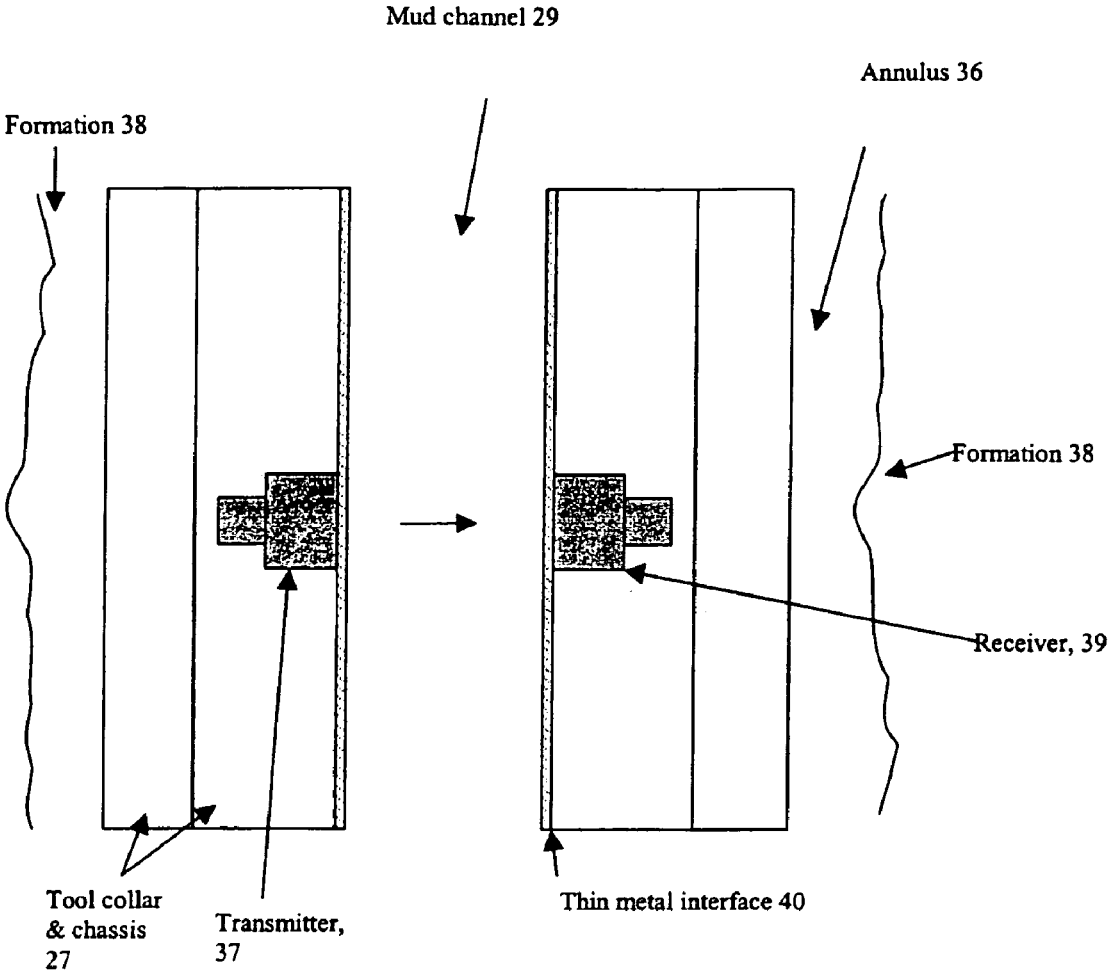
FIG. 3 shows an apparatus for measuring the velocity of an ultrasound pulse according to one embodiment of the invention.

One or more embodiments of the invention relate to methods and apparatus for determining the velocity of an ultrasound pulse in downhole environments. FIG. 3 shows an apparatus according to one embodiment of the invention. The apparatus is shown disposed in a borehole drilled through a formation 38, and includes a tool collar and chassis (27) defining a mud channel (29) therein. The area between the apparatus and the formation is known as the annulus 36. The mud channel (29) is typically approximately 5 cm in diameter and provides a path through which drilling mud may be pumped into the borehole. The mud then returns to the surface, together with drilling cuttings and other contaminants, via the annulus 36.

The apparatus of this embodiment includes a first ultrasound transducer (37) and a second ultrasound transducer (39) located across the mud channel (29) and facing each other. The transducers are separated from the mud channel by a thin interface 40, which may be metal and approximately 5 mm thick. The thin interface protects the transducers from the contents of the mud channel while permitting transmission and reception of ultrasound pulses there through. Apparatus 27 further includes circuitry for controlling the ultrasound transducers and for recording the received signal as shown and described in connection with FIG. 10. The first ultrasound transducer (37) is used as a transmitter, while the second ultrasound transducer (39) is used as a receiver. This particular configuration is referred to as a "pitch-catch" configuration. This embodiment may be incorporated into any logging tool to determine the velocity of an ultrasound pulse in the mud in downhole environments.

A method for measuring the velocity of an ultrasound pulse using the apparatus (27) includes the following steps. First, an ultrasound pulse is transmitted from the first ultrasound transducer (37) into the mud channel (29). Then, the time that takes the ultrasound pulse to travel from the first ultrasound transducer (37) through the mud in the channel to the second ultrasound transducer (39) is measured. Finally, the travel time is used to determine the velocity of the ultrasound pulse based on the diameter of the mud channel ($D_{mc}$).

Figure 4:
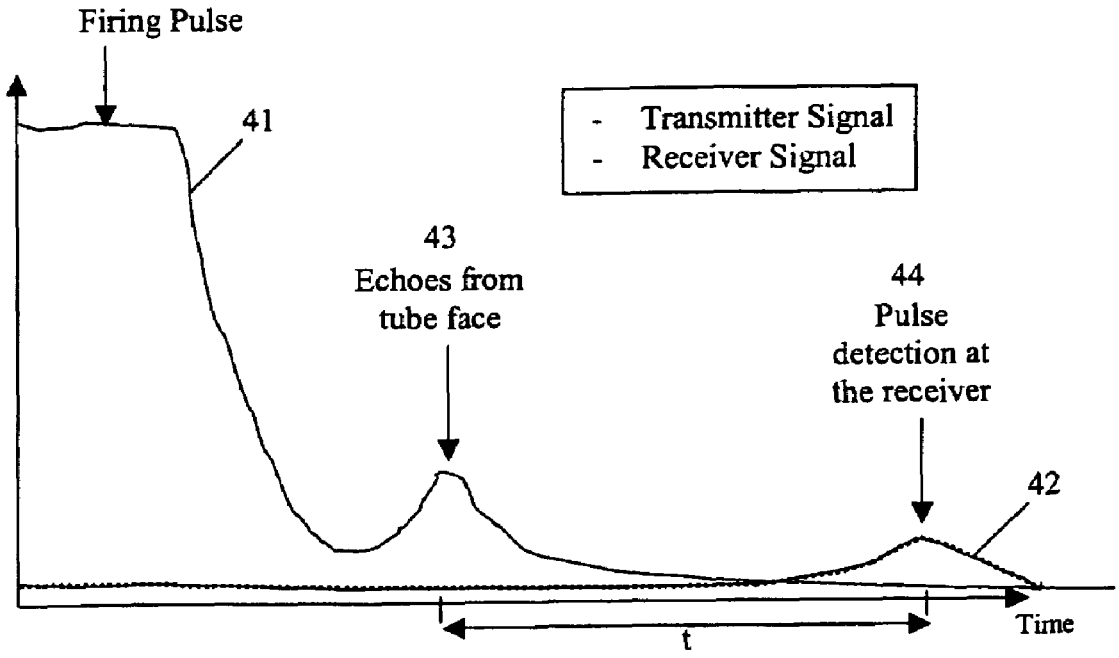
FIG. 4 shows a recording of ultrasound measurement using the apparatus shown in FIG. 3.

FIG. 4 shows a typical recording from a measurement using an apparatus in the pitch-catch configuration shown in FIG. 3. Trace (41) is a recording from the first ultrasound transducer (37). This trace includes a peak (43), which indicates the time when the ultrasound pulse leaves the front face of the first ultrasound transducer (37). Trace (42) is a recording from the second ultrasound transducer (39), which includes a peak (44) that resulted from the detection of the ultrasound pulse by the second ultrasound transducer (39). The time lapse (t) between peak (43) and peak (44) represents the time required for the ultrasound pulse to travel from the first ultrasound transducer (37) to the second ultrasound transducer (39). Because the distance between the two transducers is known, the velocity of the ultrasound pulse in the mud channel can be computed from the time lapse between the detection of the first peak (43) and the second peak (44).

Figure 5:
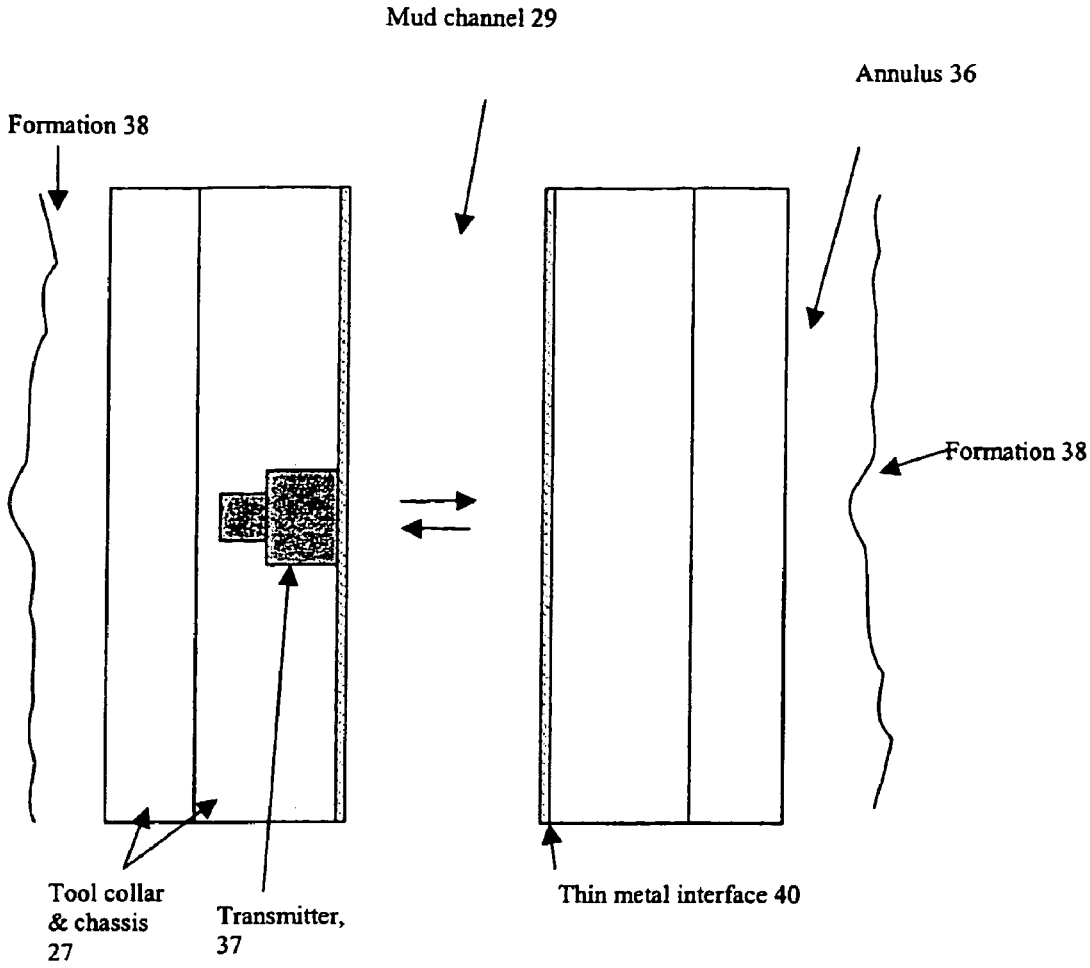
FIG. 5 shows an apparatus for measuring the velocity of an ultrasound pulse according to another embodiment of the invention.

FIG. 5 shows another embodiment of the invention having a single ultrasound transducer (37) that functions to both transmit and receive ultrasound pulses. This particular configuration is referred to as a "pulse-echo" configuration. In this embodiment, an ultrasound pulse is first transmitted substantially perpendicular to the mud channel (29). The ultrasound pulse bounces off the mud-metal interface at the interface (40), and the reflected ultrasound pulse (echo) is detected by the ultrasound transducer (37).

Figure 6:
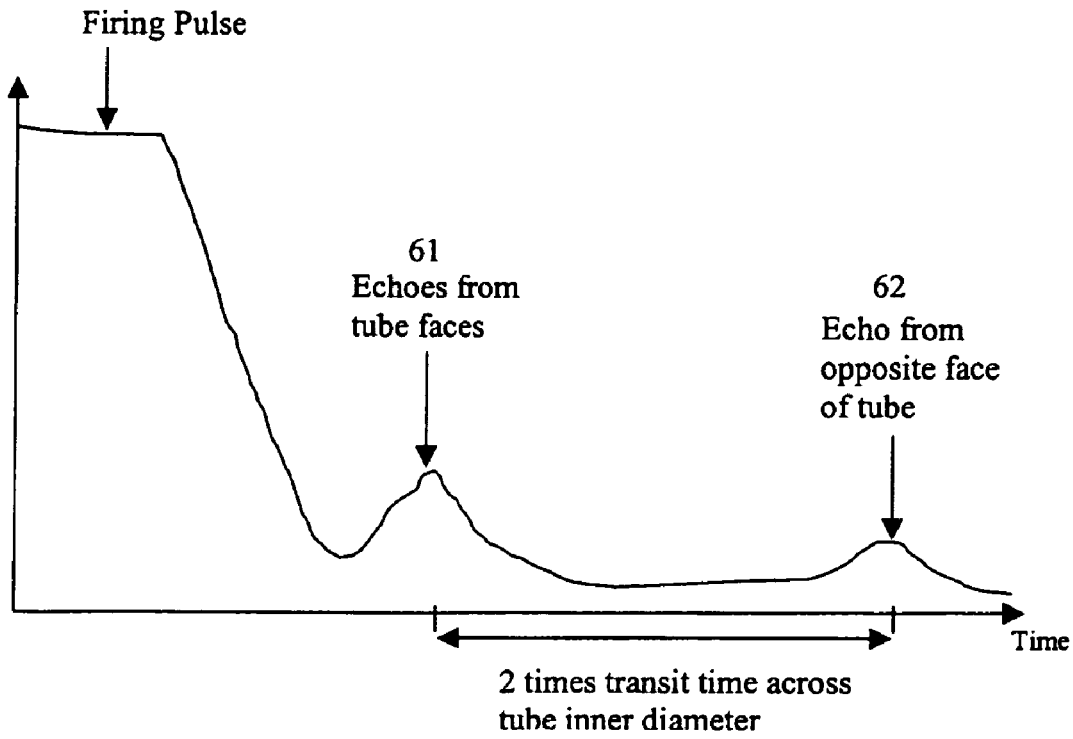
FIG. 6 shows a recording of ultrasound measurement using the apparatus shown in FIG. 5.

FIG. 6 shows a typical recording using the pulse-echo apparatus shown in FIG. 5. In FIG. 6, the first peak (61) reflects the time when the ultrasound pulse leaves the front face of the ultrasound transducer (37) and the second peak (62) indicates the time when the ultrasound pulse (echo) reaches the transducer (37) after having been reflected by the metal interface (40) on the opposite side of the mud channel. The time lapse (t) between the first and the second peaks is the time it takes the ultrasound pulse to travel twice the diameter of the mud channel ($D_{mc}$). The velocity of propagation of the ultrasound pulse within the mud channel (29) is computed by dividing the mud channel diameter ($D_{mc}$) by one half the travel time (t/2).

The "pitch-catch" embodiment of FIG. 3 and the "pulse-echo" embodiment of FIG. 5 have various relative advantages and disadvantages, and thus an appropriate configuration may be chosen for a desired application. In the case of the pulse-echo configuration, the sound wave emitted by the transmitter (37) has to go through three interfaces before being detected by the same sensor. The first interface is metal-mud, the second interface is mud-metal in the opposite wall of the mud channel, and the last interface is the mud-metal interface back at the transducer (37). Sound wave travel is governed by the laws of transmission and reflection. Given the difference in acoustic impedance between the mud and metal, most of the energy is going to be reflected back at the transducer on the first interface. The little energy transmitted (transmission coefficient, T~0.09) has then to travel across the mud channel, being attenuated by the mud and be reflected into the second interface. Here more of the signal is recovered (reflection coefficient, R~0.8). Then, the reflected signal must travel back to the original interface, suffering the same attenuation as in the first leg across. Finally, the wave must cross the mud/steel interface and reach the transducer, although this time the transmission coefficient is favorable and thus there is almost no loss.

The pitch-catch configuration has the advantages that the attenuation of the mud channel medium is encountered only once, and that there are two interfaces for the pulse to cross rather than three. Thus, it is easier to detect the pulse of interest. The pulse-echo configuration, however, has the advantage of more simple construction.

The apparatus shown in FIGS. 3 and 5 are useful for determining the velocity of an ultrasound pulse in the mud before the mud is contaminated with earth cuttings or formation fluids. In both configurations, the known diameter of the mud channel ($D_{mc}$) is used to calculate the velocity of the ultrasound pulse. One skilled in the art would appreciate that these configurations can be easily adapted to measure the velocity of an ultrasound pulse in the annulus, instead of in the mud channel. For example, the first and second ultrasound transducers (37 and 39) may be arranged on the opposite walls of an exterior groove, instead of the internal mud channel, on the tool.

Figure 7:
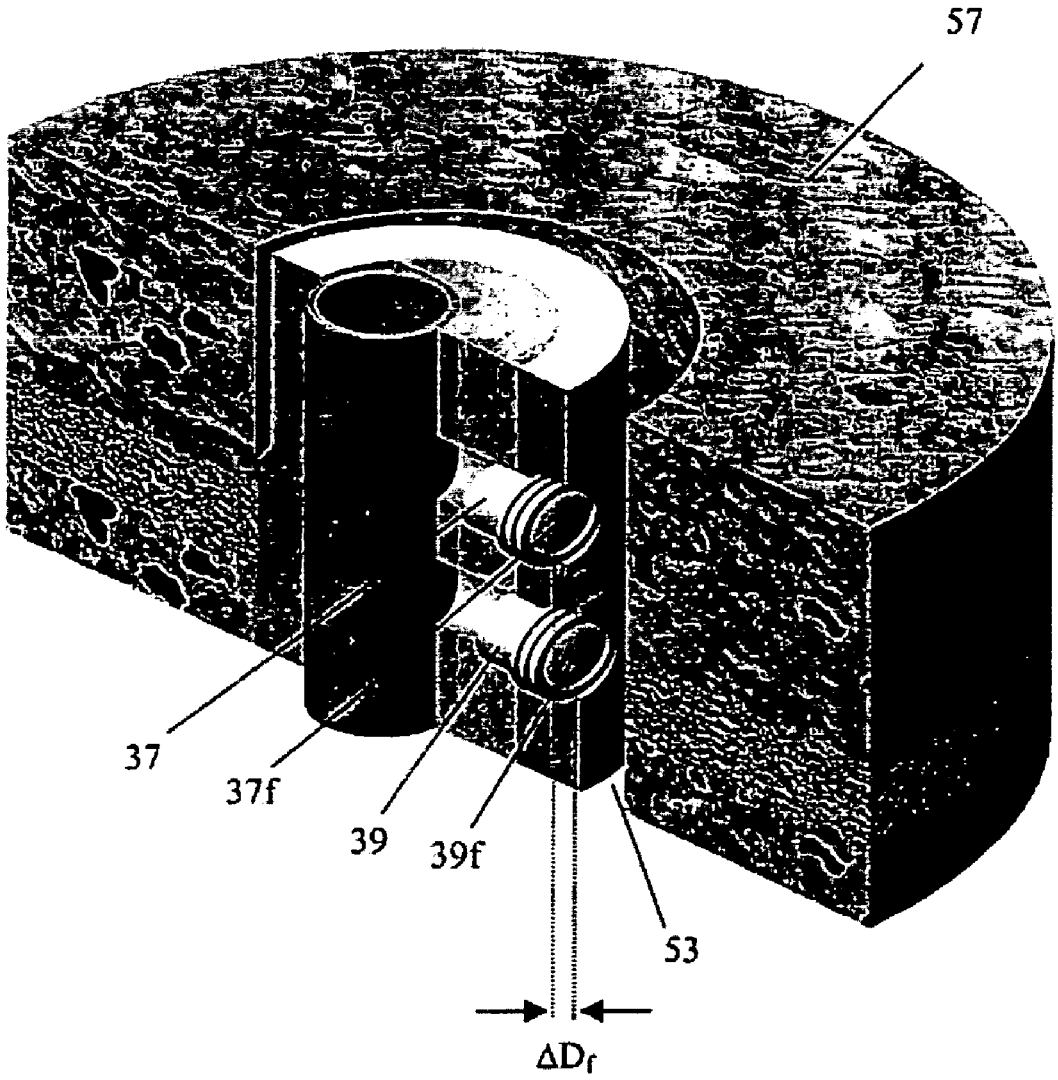
FIG. 7 shows borehole having an apparatus for measuring the velocity of an ultrasound pulse according to another embodiment of the invention.
Figure 8:
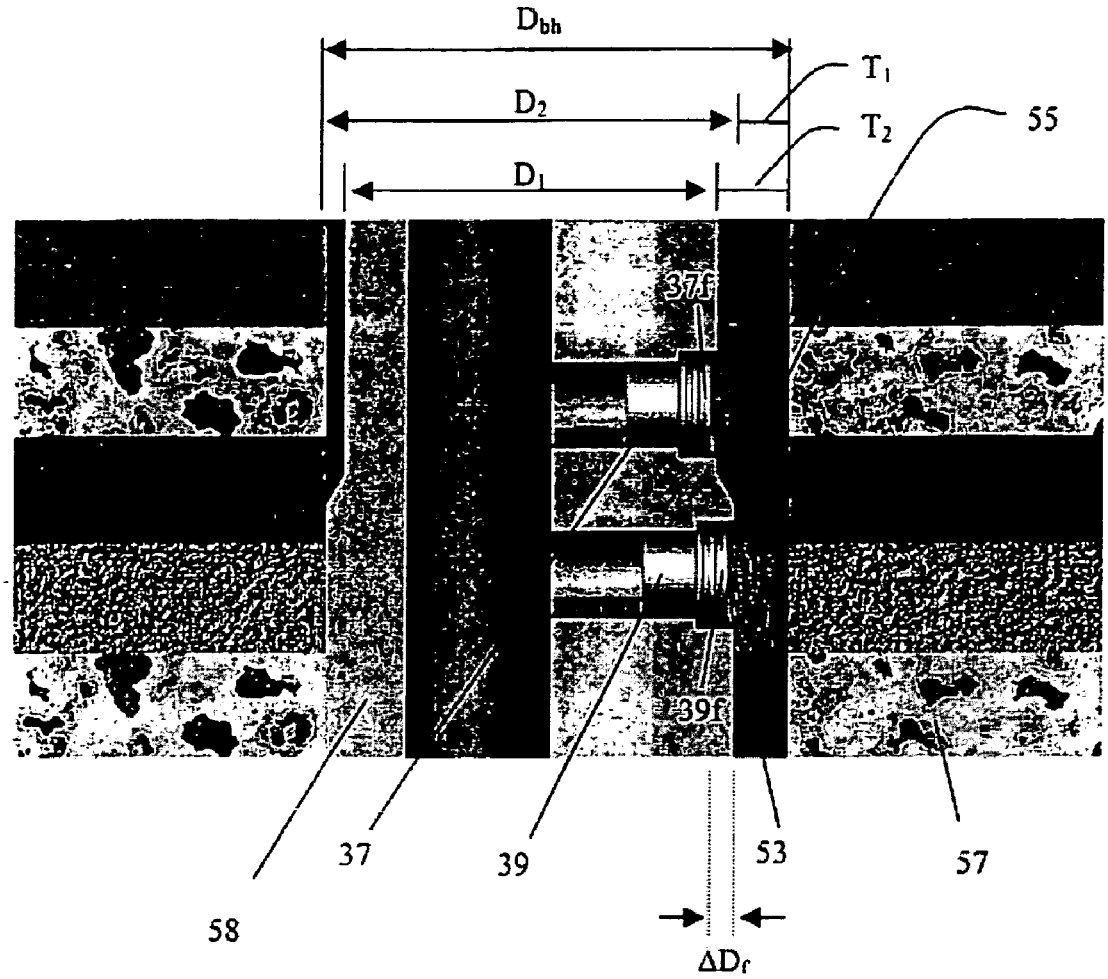
FIG. 8 shows the side view of borehole having an apparatus for measuring the velocity of an ultrasound pulse according to another embodiment of the invention shown in FIG. 7.

FIG. 7 is a prospective view showing an apparatus including first and second ultrasonic transducers (37 and 39) according to another embodiment of the invention. FIG. 8 shows the same apparatus in cross section. The apparatus is shown as part of a tool (58) disposed in a borehole formed in a formation (57) such that an annulus exists between the tool (58) and the borehole wall (55). The apparatus of this embodiment uses a predetermined distance offset ($\Delta D_f$) between the front face (37*f*) of the first transducer (37) and the front face (39*f*) of the second transducer (39) for velocity calculation. An apparatus in this configuration can be used to determine the velocity of an ultrasound pulse in the annulus, even when the distance from the tool to the borehole wall (55) is not known.

To determine the velocity of an ultrasound pulse using the apparatus shown in FIGS. 7 and 8, an ultrasound pulse is transmitted from each of the transducers (37 and 39), either simultaneously or in sequence. The time for each ultrasound pulse to travel a reflecting interface such as the borehole wall (55) and back to the respective transducer that transmitted the pulse is measured. The difference in the travel times ($T_2-T_1$) reflects the time it takes the ultrasound pulse, transmitted by the transducer 37, farther from the reflecting interface, to travel twice the predetermined offset distance ($\Delta D_f$). The velocity of the ultrasound pulse may be calculated by dividing 2 $\Delta D_f$ by the difference in the travel times ($T_2-T_1$).

For the velocity measurement of this embodiment, several assumptions should be made: 1) the tool is parallel to the well axis; 2) the tool has not moved with respect to the borehole wall in between the firings; 3) the apparatus is reflecting approximately from the same isotropic acoustic-borehole-wall and there is no effect of rugosity; and 4) the diameter of the borehole does not change enough to cause a misinterpretation of the difference. Preferably, a spacing of approximately 5 cm or more is provided between the centers of the transducers to minimize cross-talk. Although the formation (57) in FIGS. 7 and 8 is shown as being made up of various layers for illustrative purposes, for the purposes of the assumptions above it should be understood that the Figures are not to scale, and that the separation between the transducers is actually much smaller than the thickness of a typical formation layer. Thus, at any point in the borehole, it is assumed that both transducers are looking at the same layer of the formation.

Alternatively, a single ultrasound pulse may be emitted from either the first ultrasound transducer (37) or the second ultrasound transducer (39) and the reflected pulse (echo) is detected by both transducers (37) and (39). The difference between the times required for the reflected pulse (echo) to travel back to the first ultrasound transducer (37) and the second ultrasound transducer (39) corresponds to the time required for the ultrasound pulse to travel a distance that equals the predetermined offset ($\Delta D_f$). In this case, the velocity of the ultrasound pulse may be determined by dividing $\Delta D_f$ by the difference in the travel times ($T_2$-$T_1$).

The apparatus of this embodiment is useful for determining the velocity of an ultrasound pulse in the mud in the annulus. The mud in the annulus is frequently mixed with earth cuttings and/or formation fluids. With the ability to determine a precise velocity of an ultrasound pulse in the mud in annulus, it becomes possible to infer the properties (e.g., temperatures, pressure, compressibility, or formation fluid contamination) of the mud in the annulus.

The apparatus shown in FIGS. 7 and 8 also may be used to determine a borehole diameter. Once the velocity of the ultrasound pulse is determined, the borehole diameter may be derived from the travel times of the ultrasound pulses through the annulus. Because the diameter of the logging tool is known, the diameter of the borehole may be determined by adding to the latter the distances between the outer walls of the tool and the inner wall of the borehole.

The borehole diameter may be determined in an alternative way by using the apparatus of this embodiment of the invention. Referring to the cross-sectional view of FIG. 8, the tool body (58) may be configured to have two sections having different diameters ($D_1$ and $D_2$). The first ultrasound transducer (37) and the second ultrasound transducer (39) are each located at a different section on the tool such that the front face (37*f*) of the first ultrasound transducer (37) and the front face (39*f*) of the second ultrasound transducer (39) are disposed at a predetermined offset $\Delta D_f$ that equals half the difference in the diameters of the two sections of the tool, ½($D_2$–$D_1$). It is clear from FIG. 8 that:

$$D_{bh}=D_2+(V_{mud})(T_1)/2 \quad (1)$$

and $$D_{bh}=D1+(D_2-D_1)/2+(V_{mud})(T_2)/2 \quad (2)$$

where $D_1$ is the diameter of the first section on the tool where the ultrasound transducer (37) is located, $D_2$ is the diameter of the second section of the tool where the ultrasound transducer (39) is located, $V_{mud}$ is the velocity of the ultrasound pulse, $D_{bh}$ is the borehole diameter, and $T_1$ and $T_2$ are the two-way travel times measured by the first and second ultrasound transducers (37 and 39), respectively. Equations (1) and (2) may be rearranged to produce the following relationships:

$$V_{mud}=(D_2-D)/(T_2-T_1) \quad (3)$$

and $$D_{bh}=D_2+\tfrac{1}{2}T_1[(D_2-D_1)/(T_2-T_1)] \quad (4)$$

Equation (3) can be used to derive the velocity of an ultrasound pulse from the difference in travel times ($T_2$–$T_1$) and the difference in diameters of the two sections of the tool ($D_2-D_1$). On the other hand, equation (4) may be used to derive the diameter of the borehole (53) without knowing the velocity of the ultrasound pulse. One skilled in the art would appreciate that it is also possible to use a phase difference ($\Delta\phi$) between the two echoes, instead of the travel time difference ($T_2-T_1$), to calculate the velocity of the ultrasound pulse ($V_{mud}$) or the distance to the target surface (d).

The methods and apparatus of the invention for determining the velocity of an ultrasound pulse as well as for measuring, for example, the radius of a borehole, can be included in a great variety of downhole tools, for example, a logging-while-drilling tool shown in FIG. 1.

Figure 9:
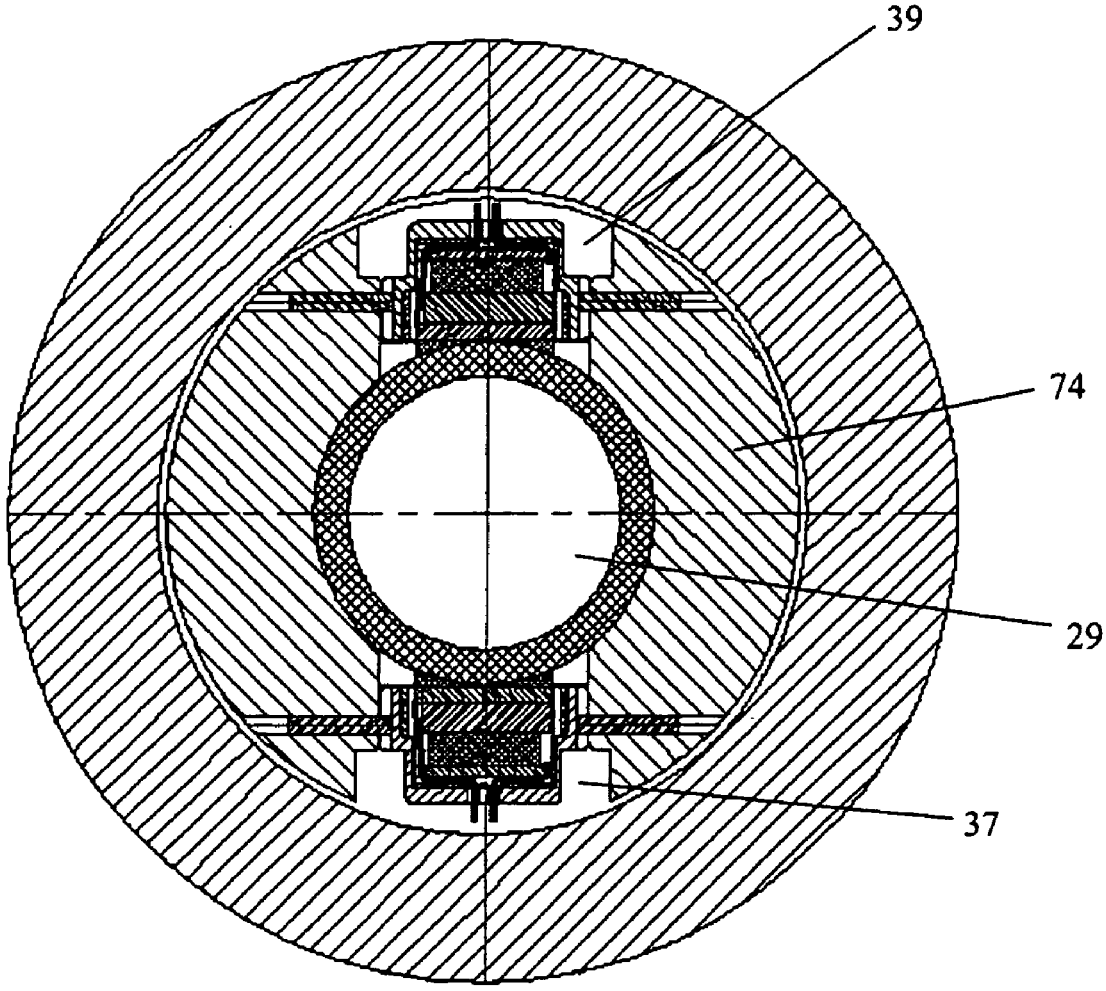
FIG. 9 shows a cross section of a tool having an apparatus for measuring the velocity of an ultrasound pulse according to the embodiment of the invention shown in FIG. 3.

For example, FIG. 9 shows a cross section of a pitch-catch ultrasound device incorporated as part of an LWD tool. Two ultrasound transducers (37 and 39) are included in the tool chassis (74) of an LWD tool and are disposed across the mud channel (29). The ultrasound transducers (37 and 39) are connected to downhole circuitry (not shown) for controlling the ultrasound pulses and for recording the received signal as a function of time.

Figure 10:
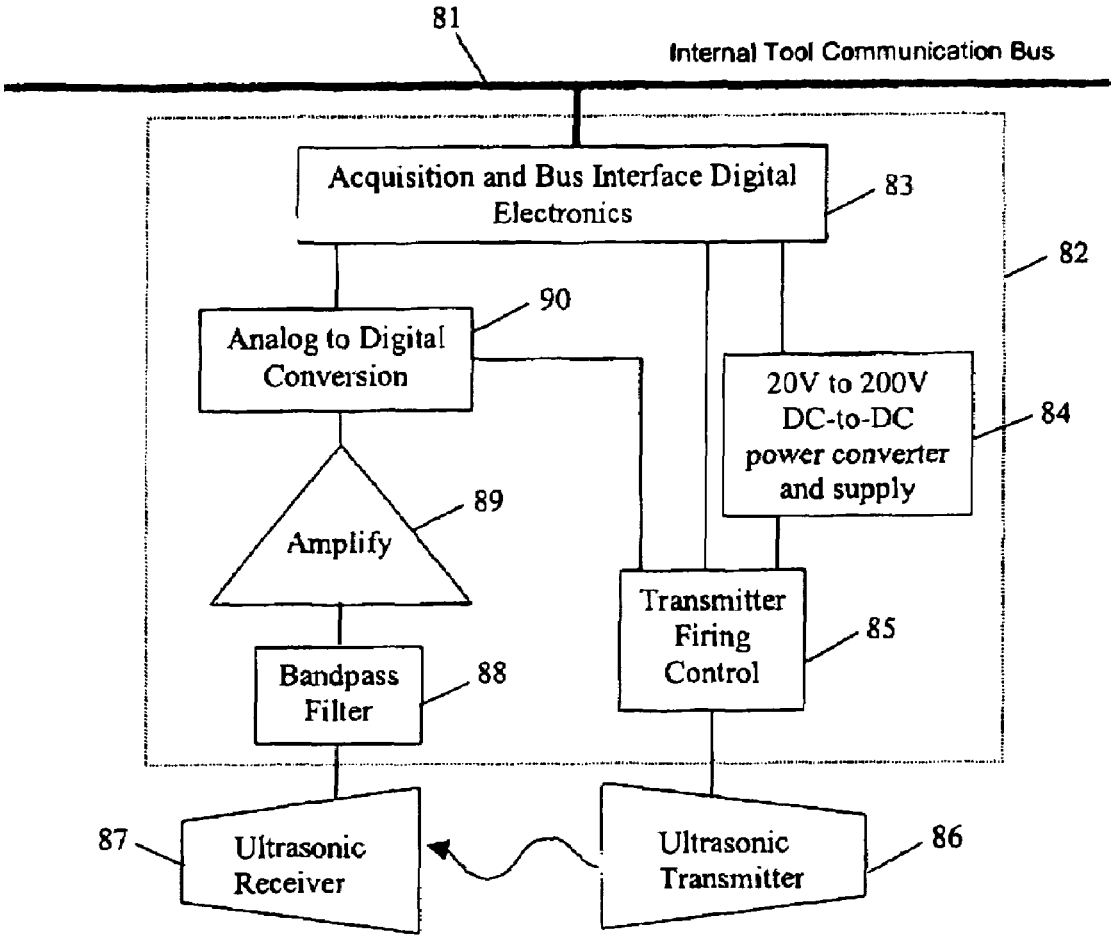
FIG. 10 shows a schematic of a control circuitry according to one embodiment of the invention.

FIG. 10 illustrates circuitry (82) for controlling the ultrasound transducers. As shown in FIG. 10, the circuitry (82) communicates with internal tool communication bus (81) via an acquisition and bus interface (83). The interface (83) connects a transmitter firing control (85), which obtains its power from a voltage converter and power supply (84). The transmitter firing control (85) controls the timing of the ultrasound pulse emission from the ultrasound transmitter (86). The ultrasound pulse is detected by an ultrasound receiver (87). The received signal is passed through a bandpass filter (88) and amplified by an amplifier (89). Finally, the signal is digitized by an analog to digital converter (ADC) (90) and the digitized signal is relayed by the interface (83) to the internal tool communication bus (81). The digitized signal is stored in the memory in the tool for later retrieval, processed by a downhole signal processor and/or immediately communicated to a surface processor to compute the desired results (e.g., velocity of the ultrasound pulse, borehole diameter, etc).

The present invention has several advantages. For example, it eliminates the inaccuracy of estimating the velocity of an ultrasound pulse in downhole environment from a surface measurement. Embodiments of the invention provide means for measuring the velocity of an ultrasound pulse in the mud channel or in the annulus in the downhole environment. Accurate determination of the ultrasound velocity makes it possible to infer mud properties (e.g., temperature, pressure, or compressibility) in the downhole environment.

While the invention has been described with respect to a limited number of embodiments, those skilled in the art, having the benefit of this disclosure, will appreciate that other embodiments can be devised which do not depart from the scope of the invention as disclosed herein. For example, embodiments of the invention may be used with any acoustic wave, not just ultrasound frequency. Accordingly, the scope of the invention should be limited only by the attached claims.

The invention claimed is:

1. A method for determining a velocity of ultrasound propagation in a drilling fluid flowing in a mud channel within a borehole of a downhole environment, comprising:

disposing a first ultrasound transducer (37) across the mud channel from a second ultrasound transducer (39) such that a front face (37*f*) of the first transducer (37) is offset from a front face (39*f*) of the second ultrasound transducer (39) by a predetermined radial offset distance ($\Delta$Df), wherein the transducers are separated from the mud channel by a thin interface for protecting the transducers from the drilling fluid flowing in the mud channel while permitting the ultrasound propagation there through;

emitting an ultrasound pulse into the drilling fluid in a borehole using the first ultrasound transducer(37);

detecting the ultrasound pulse after the ultrasound pulse has travelled through the drilling fluid a distance (d);

determining a travel time (t) for the ultrasound pulse to travel the distance (d) through the drilling fluid in the borehole between the first and second transducers; and determining the velocity of ultrasound propagation in the drilling fluid from the distance (d) and the travel time (t).

2. The method according to claim 1, wherein the detecting the ultrasound pulse is performed with the first ultrasound transducer (37).

3. The method according to claim 1, wherein the detecting the ultrasound pulse is performed with the second ultrasound transducer (39).

4. The method according to claim 1, wherein the detecting the ultrasound pulse is performed with both the first and second ultrasound transducer.

5. The method according to claim 4, further comprising determining a borehole diameter ($D_{bh}$) using the predetermined offset distance ($\Delta$Df) and a difference in travel times ($T_2-T_1$) for the ultrasound pulse to be detected by the first ultrasound transducer (37) and the second ultrasound transducer (39).

6. The method according to claim 1, wherein the detecting the ultrasound pulse is performed by the first ultrasound transducer (37), and wherein the method further comprises:

emitting a second ultrasound pulse into the drilling fluid in the borehole using the second ultrasound transducer (39); and detecting the second ultrasound pulse after the second ultrasound pulse has traveled through the drilling fluid a distance ($d+2\Delta D_f$) using the second ultrasound transducer (39).

7. The method according to claim 6, wherein the ultrasound pulse and the second ultrasound pulse are emitted simultaneously.

8. The method according to claim 1, wherein the drilling fluid is located in an annulus between a tool and a borehole wall.

9. An apparatus for determining a velocity of ultrasound propagation in a drilling fluid within a borehole of a downhole environment, comprising:

a first ultrasound transducer (37) disposed on a tool;

a second ultrasound transducer (39) across the mud channel from a second ultrasound transducer (39) such that a front face (37*f*) of the first transducer (37) is offset from a front face (39*f*) of the second ultrasound transducer (39) by a predetermined radial offset distance ($\Delta$Df), wherein the transducers are separated from the mud channel by a thin interface for protecting the transducers from the drilling fluid flowing in the mud channel while permitting the ultrasound propagation there through; and a circuitry (82) for controlling a timing of an ultrasound pulse transmitted by the first ultrasound transducer (37) and for measuring a time lapse between ultrasound transmission and detection after the ultrasound pulse has traveled a distance (d) through the drilling fluid in the borehole between the first and second transducers.

10. The apparatus according to claim 9, wherein the first ultrasound transducer (37) and the second ultrasound transducer (39) are disposed on an outside surface of the tool.

11. Apparatus for determining a velocity of ultrasound propagation in drilling mud, the apparatus comprising:

a tool chassis located within a borehole, the chassis is shaped to define a mud channel therein for providing a path through which the drilling mud is pumped into the borehole;

a first and a second ultrasonic transducer located across the mud channel and facing each other spaced at a distance (d), wherein the transducers are separated from the mud channel by a thin interface for protecting the transducers from the drilling fluid flowing in the mud channel while permitting the ultrasound propagation there through;

circuitry for controlling the first and the second transducers to measure a time lapse between ultrasound transmission and detection after an ultrasound pulse has traveled the distance (d) across the drilling mud, and is thereby able to determine the velocity of ultrasound propagation in the drilling mud.

* * * * *